US007077168B2

(12) United States Patent
Herrlein et al.

(10) Patent No.: US 7,077,168 B2
(45) Date of Patent: Jul. 18, 2006

(54) THREAD TENSION REGULATION IN A THREAD BRAKE DEVICE AND METHOD IN A TEXTILE PROCESSING MACHINE

(75) Inventors: Wilhelm Herrlein, Wangen (DE); Manuel Renz, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 395 days.

(21) Appl. No.: 10/422,042

(22) Filed: Apr. 23, 2003

(65) Prior Publication Data

US 2003/0196718 A1 Oct. 23, 2003

(30) Foreign Application Priority Data

Apr. 23, 2002 (DE) ..... 102 18 059

(51) Int. Cl.
*D03S 41/00* (2006.01)

(52) U.S. Cl. ..... 139/194; 242/410

(58) Field of Classification Search ..... 139/100, 139/103; 242/410, 420.5, 419.1, 419.4, 419.3, 242/419, 10, 420.6; 226/39, 45, 195
See application file for complete search history.

(56) References Cited

U.S. PATENT DOCUMENTS

| | | | | |
|---|---|---|---|---|
| 4,641,688 A | | 2/1987 | Gehring | |
| 4,817,681 A | | 4/1989 | Krumm et al. | |
| 4,884,763 A | * | 12/1989 | Rydborn | 242/148 |
| 5,027,484 A | * | 7/1991 | Baba | 28/185 |
| 5,179,980 A | | 1/1993 | Hubner et al. | |
| 5,329,822 A | | 7/1994 | Hartel et al. | |
| 5,398,731 A | | 3/1995 | Schuster | |
| 5,476,122 A | | 12/1995 | Schuster et al. | |
| 5,725,029 A | | 3/1998 | Loehr et al. | |
| 5,738,295 A | * | 4/1998 | Flamm et al. | 242/419.1 |
| 5,842,661 A | * | 12/1998 | Hohne et al. | 242/419.1 |
| 6,257,284 B1 | | 7/2001 | Schuster | |
| 6,418,976 B1 | | 7/2002 | Loehr et al. | |

FOREIGN PATENT DOCUMENTS

| | | |
|---|---|---|
| DE | 3446567 | 5/1986 |
| DE | 4306911 | 12/1993 |
| EP | 0296132 | 12/1988 |
| EP | 0467059 | 1/1992 |
| EP | 0475892 | 3/1992 |

* cited by examiner

*Primary Examiner*—John J. Calvert
*Assistant Examiner*—Andrew W. Sutton
(74) *Attorney, Agent, or Firm*—W. F. Fasse; W. G. Fasse

(57) ABSTRACT

A thread brake arrangement for use in a textile processing machine includes two brake elements with the thread running there between. An actuator, preferably a piezoelectric actuator, variably actuates one of the brake elements relative to the other to exert an adjustable braking force onto the thread. The thread exerts a reaction force in the thread running direction onto the brake elements. At least one of the brake elements is movably supported to be movable along the thread running direction, and is mechanically coupled to a force transducer that measures the reaction force, which is proportional or equal to the thread tension force. A regulating arrangement receives the measured force signal, and controls the actuator to adjust the adjustable brake element, so as to vary the applied braking force and thus regulate the arising thread tension responsive to and dependent on the measured reaction force.

20 Claims, 2 Drawing Sheets

THREAD TENSION REGULATION IN A THREAD BRAKE DEVICE AND METHOD IN A TEXTILE PROCESSING MACHINE

PRIORITY CLAIM

This application is based on and claims the priority under 35 U.S.C. §119 of German Patent Application 102 18 059.8, filed on Apr. 23, 2002, the entire disclosure of which is incorporated herein by reference.

FIELD OF THE INVENTION

The invention relates to an apparatus and a method for regulating the thread tension in connection with selective braking of the thread in a textile processing machine, especially in a weaving loom.

BACKGROUND INFORMATION

Such devices pertinent to the general background of the present invention, often known as thread brakes, are well known in many different conventional configurations and arrangements, and are typically used, for example, as weft thread brakes in weaving looms.

German Patent 34 46 567 and corresponding U.S. Pat. No. 4,641,688 disclose a weft thread brake with a controllable braking effect. This known weft thread brake comprises two lamellar brake elements that are arranged opposite each other and press against each other in a spring-elastic manner, with the weft thread received therebetween. The known thread brake arrangement further comprises at least one controllable electromagnetic actuator that selectively acts on and moves or applies a force to at least one of the lamellar brake elements relative to the other, and thereby causes an adjustable braking force to be applied to the thread passing between the two lamellar brake elements.

A similar embodiment and construction of a weft thread brake is known from German Patent 43 06 911 and corresponding U.S. Pat. No. 5,398,731. The basic construction of this known thread brake also includes two lamellar brake elements that selectively or adjustably press against each other, with the weft thread passing therebetween. The position and force of at least one of the lamellar brake elements relative to the other is adjustable by means of a stepper motor, and an actuating cam element that is mounted eccentrically on the shaft of the stepper motor, so that the actuating cam variably acts on the lamellar brake elements due to the stepping rotation of the stepper motor.

A great number and variety of other types of thread brakes are generally known in the art of textile processing machines. For example, some known thread brakes operate with a brake band and a controllable brake body, with the weft thread guided therebetween, for example according to European Patent 0,475,892. Another type of thread brake involves a so-called thread looping or wrapping brake, in which the thread is deflected, looped, or wrapped to a variable extent around a braking element, and the applied braking force is adjustable by changing the thread deflection or looping angle. The basic principle of such a brake arrangement is described in connection with the thread tensioning apparatus in European Patent Specification 0,467,059.

In all of the known apparatuses in this context, the overall thread brake arrangement essentially consists of the actual thread break device itself together with an additional thread tension sensor. Namely, the thread tension is measured by an additional or separate thread tension sensor in order to then control the actuation of the thread brake in response to and dependent on the measured thread tension. Unfortunately, in all of the known arrangements, the separate thread tension sensor requires the thread to be deflected around a suitable measuring element in order to be able to measure the actual presently existing thread tension, which is representative of or associated with the applied braking force. In this manner, a force proportional to the actual existing thread tension is exerted onto the suitable measuring element, which then provides a signal representative of the thread tension.

The use of such a thread tension sensing arrangement is disadvantageous, because the necessary additional deflection of the thread also causes an additional mechanical loading of the thread, which is undesirable and unnecessary. This is especially evident when it is considered that this additional deflection and loading of the thread by the tension sensing arrangement also arises even when the thread brake is not operating, i.e. when the brake is fully opened to allow the thread to pass therethrough without any braking effect.

SUMMARY OF THE INVENTION

In view of the above, it is an object of the invention to provide a thread brake arrangement and a thread braking method for regulating the thread tension of a thread in a textile processing machine, while minimizing the mechanical loading of the thread. More particularly, it is an object of the invention to avoid a separate thread tension sensor device in addition to the thread brake, and especially also to avoid unnecessary deflections of the thread, so as to reduce the mechanical loading on the thread. The invention further aims to avoid or overcome the disadvantages of the prior art, and to achieve additional advantages, as apparent from the present specification.

The above objects have been achieved according to the invention in an apparatus for regulating the thread tension of a thread in a textile processing machine, comprising at least one brake element that acts on the thread so as to apply an adjustable braking force to the thread, as well as a force pickup transducer mechanically coupled to the brake element for measuring a reaction force exerted by the thread onto the brake element. This reaction force is oriented in the running direction of the thread and is proportional to the thread tension. The inventive apparatus further comprises a regulating arrangement or control device for regulating the thread tension by selectively actuating the brake element to selectively vary or adjust the braking force responsive to and dependent on the measured reaction force.

The above objects have further been achieved according to the invention in a method for regulating the thread tension of a thread in a textile processing machine, comprising the following steps: applying a braking force to the thread with an adjustable thread brake element; exerting a reaction force, which is oriented in the running direction of the thread and proportional to the thread tension, from the thread onto the thread brake element; measuring or sensing the reaction force that is exerted on the thread brake element, using a force pickup transducer; and regulating the thread tension by varying or adjusting the braking force dependent on and responsive to the measured reaction force.

The new basic principle for achieving a controlled thread braking effect according to the invention is that the thread tension is applied or caused by the brake element and is simultaneously measured directly on the brake element (via the reaction force or counter force that is exerted by the thread onto the brake element). In this manner, the braking force of the brake element applied to the thread can be regulated dependent on and responsive to the thread tension. The thread tension is measured directly by the reaction force exerted on the brake element by the thread, so that a separate thread tension sensor is no longer necessary.

The thread tension is simultaneously monitored and regulated through the brake element or elements. As discussed above, in conventional arrangements and methods, the thread had to be deflected, for example around a thread tension sensor element, for carrying out the thread tension measurement. On the other hand, in the present inventive solution, no additional thread tension sensor is needed, and the thread does not need to be deflected out of its linear thread travel path for achieving the thread tension measurement. Thus, when no braking effect is to be applied to the thread, e.g. when the thread is to be supplied with a free feed advance through the open brake, the thread will be guided completely freely through the open brake arrangement, without any mechanical load or deflection being applied to the thread. Moreover, the thread, e.g. the weft thread, can be guided through the thread brake arrangement absolutely linearly without any deflection out of such a linear thread path for achieving both the thread tension measurement and the thread braking.

According to a preferred embodiment of the invention, the thread brake arrangement comprises two brake elements or force application elements that are arranged opposite one another and receive the thread passing therebetween. For example, the two force application elements may be two lamellar brake elements, or two rigid brake plates or shoes, or one lamellar brake element and one rigid brake plate or shoe. A controllable actuating element acts on at least one of the force application elements, so as to vary or adjust the position and the pressing force of at least one of the force application elements relative to the other.

At least one of the force application elements is supported so that it is movable, and preferably linearly movable, along or parallel to the running direction of the thread. Moreover, a force pickup transducer is mechanically coupled to this movable force application element so as to sense force acting on this element and/or the motion of this element along or parallel to the thread running direction. This force pickup transducer is preferably embodied as a piezoelectric force transducer. With this arrangement, the reaction force or drag force exerted by the thread onto the force application element or elements of the brake arrangement causes a corresponding motion of the force application element or elements in the running direction of the thread, and this motion is sensed by the force transducer, to provide a signal indicative of or especially proportional to the actual presently existing thread tension.

The controllable actuator element acting on at least one of the force application elements may also preferably be embodied as a piezoelectric actuating element. Such a piezoelectric actuating element is able to carry out very rapid actuating motions. Thus, the selective variable application of the braking force onto the thread can be very rapidly adjusted dependent on and responsive to the reaction force that is measured in the above described manner. In effect, the inventive arrangement provides a very rapidly acting feedback loop of the force information, which allows a rapid regulation of the braking force and the resulting thread tension.

BRIEF DESCRIPTION OF THE DRAWINGS

In order that the invention may be clearly understood, it will now be described in detail in connection with example embodiments thereof, with reference to the accompanying drawings, wherein.

DETAILED DESCRIPTION OF A PREFERRED EXAMPLE EMBODIMENT AND OF THE BEST MODE OF THE INVENTION

Figure 1:
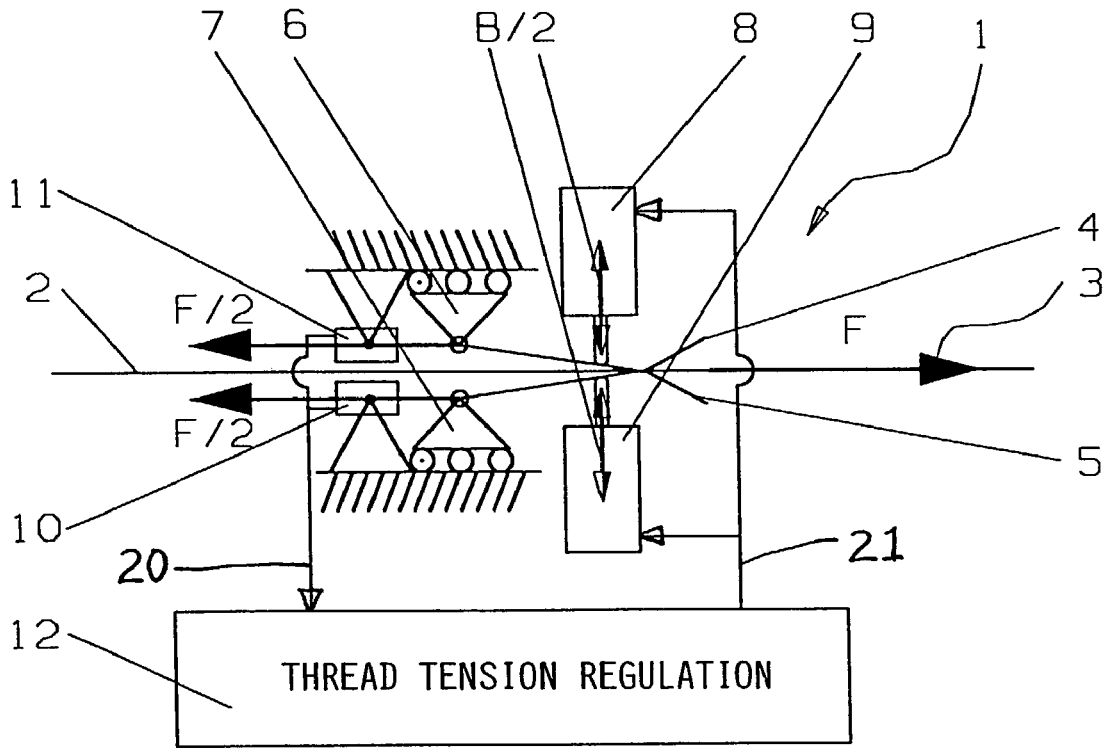
FIG. 1 is a simplified schematic diagram of a first embodiment of a regulated thread brake arrangement according to the invention.

FIG. 1 schematically shows a thread brake arrangement 1 according to the invention, as it may be used for braking a weft thread in a weaving loom. The thread 2 is guided and extends in a threading running or feed direction 3 along a straight linear thread travel path through the thread brake arrangement 1. The thread brake arrangement 1 includes two lamellar brake elements 4 and 5, for example thin metal sheets or lamellae 4 and 5, which are elastically flexible and elastically pressed against one another, with the thread 2 received running therebetween. The thread brake arrangement 1 further includes two opposed actuators or operating elements 8 and 9 that selectively act on the two lamellar brake elements 4 and 5 in opposite directions as shown by the double-headed arrows, to apply a controllable actuating displacement and/or force to the brake elements 4 and 5, so as to exert a controllable braking force B via the brake elements 4 and 5 onto the thread 2.

When the thread brake is open, i.e. when no braking force is to be exerted on the thread 2, and therefore the brake elements 4 and 5 are moved maximally away from each other by the actuators 8 and 9, the thread 2 runs unhindered and without contact between the brake elements 4 and 5 in the thread running or feed direction 3. In this condition, no braking force B is applied to the thread 2, and the thread 2 also does not undergo any deflection out of its linear thread path along the thread feed direction 3, through the thread brake arrangement 1.

On the other hand, when a selected thread tension is required in the thread 2, the brake elements 4 and 5 are moved into contact with each other and pressed against each other by the controlled actuating of the actuators 8 and 9, so as to exert the braking force B onto the thread 2 between the brake elements 4 and 5, whereby a corresponding thread tension force F is caused in the thread 2. As a result, a counter-force or reaction force of F/2 is exerted by the thread 2 reactively back onto each one of the brake elements 4 and 5, respectively along or parallel to the thread running direction 3.

The brake elements 4 and 5 are supported relative to a machine frame by suitable bearing arrangements 6 and 7, which allow the brake elements 4 and 5 to move along or parallel to the thread running direction 3. Thus, when the reaction force of F/2 is exerted by the thread 2 respectively onto each one of the brake elements 4 and 5, this reaction force is not braced rigidly into the machine frame or support structure of the thread brake arrangement 1, but rather causes the brake elements 4 and 5 to move along or parallel to the thread running direction 3, as permitted by the linear movable support provided by the bearing arrangements 6 and 7. Moreover, the brake elements 4 and 5 are mechanically coupled respectively with locationally fixed force pickup transducers 10 and 11 that are rigidly mounted relative to the machine frame.

In this manner, the transducers 10 and 11 preferably and ideally receive and carry or support essentially all of the forces acting on the brake elements 4 and 5 (except for bearing friction losses of the bearings 6 and 7 and the like) in a direction along or parallel to the thread running direction 3. Thus, the reaction force F/2 acting on each one of the brake elements 4, 5, which is proportional to the actual existing thread tension force F, is introduced from the brake elements 4 and 5 into the force pickup transducers 10 and 11, which thus measure this reaction force and provide a corresponding measured force output signal at a measurement output. Via a measurement signal conductor (e.g. an electrical conductor wire or an optical conductor fiber) 20 or transmission link (e.g. an IR link or an RF link) 20, the measured force signal is provided from the measurement output of each transducer 10 and 11 to a measurement input of a thread tension regulating arrangement or control device 12.

The measured total reaction force is ideally equal to the thread tension force F, or at least dependent on and proportional to the actual existing thread tension force F, and is independent of the thread diameter and the coefficients of friction of the thread 2 and the brake elements 4 and 5. Since the thread brake elements 4 and 5 are the only elements exerting the braking force B onto the thread 2, and supporting the resulting thread tension force F, the brake elements 4 and 5 together necessarily apply or carry the reaction force equal to the thread tension force F in the opposite direction. Taking into account the behavior of the bearings 6 and 7 and the force pickup transducers 10 and 11, the measured force is thus at least directly proportional to the thread tension.

The thread tension regulating arrangement or control device 12 then evaluates the measured force signal, which provides information regarding the measured thread tension force F, and generates a control signal responsive to and dependent on the measured force F. This control signal is provided from a control signal output of the regulating arrangement 12 via a control signal conductor or transmission link 21 to the actuators or operating elements 8 and 9, so as to controllably vary the applied braking force B that is applied by the actuators 8 and 9 through the brake elements 4 and 5 onto the thread 2, and thereby regulate the thread tension. In this manner, the desired thread tension F arises in a regulated manner in the thread 2, responsive to and dependent on the measured reaction force.

The regulating arrangement 12 may comprise any conventionally known hardware, software, or combination thereof (e.g. a program controlled computer and/or a logic circuit and/or arithmetic circuitry), which is able to carry out the necessary functions and processes of receiving or determining a selected target thread tension, comparing the measured reaction force with appropriate scaling to the selected target thread tension, and generating the control signal responsive to and dependent on any deviation determined in this comparison, so as to control the actuators in a manner to drive the actual thread tension to the selected target thread tension. The control signal may be a signal that merely controls the actuators, which separately receive the required actuation power. Alternatively, the control signal may include the actuation power required by the actuators.

Figure 2:
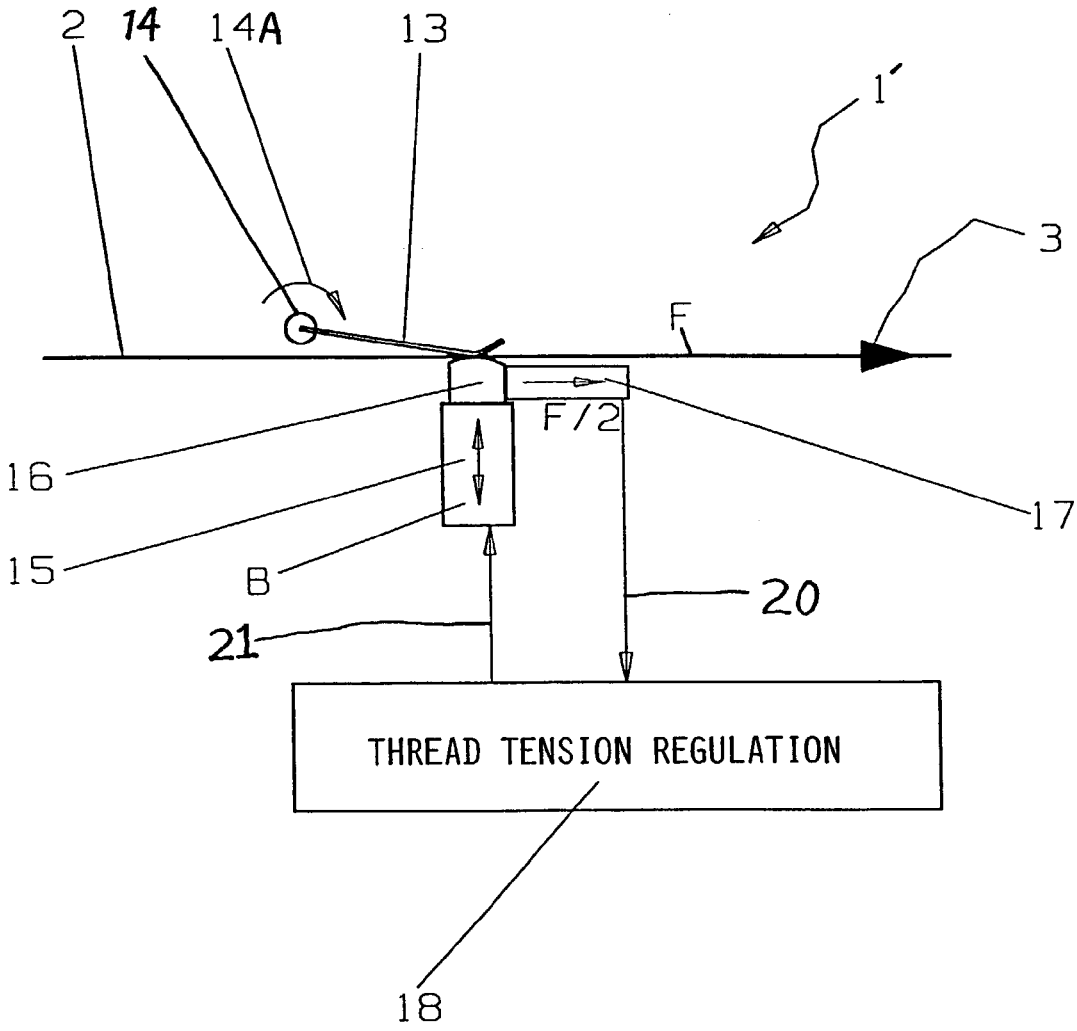
FIG. 2 is a simplified schematic diagram of a second embodiment of a regulated thread brake arrangement according to the invention.

FIG. 2 schematically illustrates a varied embodiment of the inventive thread brake arrangement 1', which operates according to a similar principle as the first embodiment of the thread brake arrangement 1 described above in connection with FIG. 1, but which has a somewhat different construction. The thread brake arrangement 1' comprises a passive lamellar brake element 13 with an adjustable elastic pretension. This brake element 13 is received and held in a locationally fixed or rigid bearing 14. This adjustable mount or bearing 14 fixedly holds the preadjusted rotational position of the brake element 13, as indicated by the rotational arc 14A, so as to elastically exert the desired preadjusted base tension.

The thread brake arrangement 1' further comprises an actuator or operating element 15, which exerts a controllable and variable braking force B to a movable brake plate, shoe or jaw 16, which contacts and presses against the elastically flexible lamellar brake element 13, with the thread received extending therebetween. As a result of the braking force B exerted on the thread 2, a corresponding thread tension force F arises in the thread 2. A drag force is in turn exerted by the thread 2 uniformly and equally (assuming equal coefficients of friction as discussed below) onto the lamellar brake element 13 and the brake plate or shoe 16, which then each support or apply a corresponding counter or reaction force F/2.

One of these two brake elements is rigidly supported with respect to the machine frame, while the other of these two brake elements is supported so as to be movable, and preferably linearly movable, along or parallel to the thread running direction 3. In the present embodiment, as mentioned above, the lamellar brake element 13 is fixedly located and supported by the bearing 14, and accordingly the brake plate or shoe 16 is supported so as to be movable in a direction along or parallel to the thread running direction 3. Thus, the counterforce or reaction force (e.g. F/2) that arises on the brake plate or shoe 16 is transmitted into a force pickup transducer 17, which is mechanically coupled to the brake plate 16 so as to support the forces of the brake plate 16 oriented along or parallel to the thread running direction 3.

In the above example, in which the reaction force is exerted uniformly and equally onto the two brake elements 13 and 16, it is assumed that the surface coefficient of friction of the two brake elements 13 and 16 is equal. As a further example, the two brake elements 13 and 16 may respectively have different coefficients of friction on their respective active brake surfaces. In that case, the total reaction force would not be equally distributed onto the two brake elements 13 and 16, but rather the brake element with the higher coefficient of friction would carry a higher proportion of the total reaction force. In any event, it is significant for the invention, that the portion of the total reaction force exerted on the brake element 16 that is mechanically coupled to the force transducer 17 is always at least proportional to the total reaction force and thus to the total thread tension force F.

The measured force signal provided by the force transducer 17 is supplied via a signal conductor or transmission link 20 to the thread tension regulating arrangement 18, whereupon this arrangement 18 provides a control signal via the signal conductor or transmission link 21 so as to regulate the thread tension by appropriately controlling the actuating element 15. Thereby, the braking force B is varied or adjusted dependent on and responsive to the measured reaction force (which is proportional to the thread tension F as discussed above), so that the desired thread tension F arises in a regulated manner in the thread 2.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for regulating the thread tension of a thread in a textile processing machine, comprising:

a thread brake arrangement including a control signal input and a first thread brake element that is arranged to adjustably press against the thread so as to apply an adjustable braking force onto the thread;

a force pickup transducer that is mechanically coupled to said first thread brake element so as to receive from said first thread brake element a reaction force that is oriented parallel to the thread and that is exerted by the thread onto said first brake element, wherein said force pickup transducer has a signal output adapted to provide a measurement signal representing a measurement of the reaction force; and a thread tension regulating arrangement that includes a measurement signal input connected to said signal output of said force pickup transducer and a control signal output connected to said control signal input of said thread brake arrangement, and that is adapted to provide at said control signal output a control signal dependent on and responsive to the measurement signal received at said measurement signal input;

wherein said thread brake arrangement adjusts said thread brake element in response to the control signal so as to adjust the braking force dependent on the reaction force.

2. The apparatus according to claim 1, further comprising a measurement signal conductor or transmission link by which said signal output of said force pickup transducer is connected to said measurement signal input of said thread tension regulating arrangement, and a control signal conductor or transmission link by which said control signal output of said thread tension regulating arrangement is connected to said control signal input of said thread brake arrangement.

3. The apparatus according to claim 1, wherein the reaction force is proportional to a thread tension of the thread.

4. The apparatus according to claim 1, wherein said first thread brake element is movably supported relative to said force pickup transducer to be movable in a direction parallel to the thread.

5. The apparatus according to claim 4, wherein said force pickup transducer is stationarily fixedly supported and arranged.

6. The apparatus according to claim 4, wherein said force pickup transducer carries essentially all forces acting on said first thread brake element in said direction parallel to the thread.

7. The apparatus according to claim 1, wherein said force pickup transducer comprises a piezoelectric transducer.

8. The apparatus according to claim 1, wherein said thread brake arrangement further includes a second thread brake element arranged opposite said first thread brake element with the thread received therebetween, and a first actuator connected to and acting on said first thread brake element so as to move and adjustably press said first thread brake element relative to said second thread brake element so that said first thread brake element adjustably presses against the thread to apply the adjustable braking force thereto.

9. The apparatus according to claim 8, wherein said first actuator comprises a piezoelectric actuator.

10. The apparatus according to claim 8, wherein said first and second thread brake elements are elastically flexible lamellar brake elements.

11. The apparatus according to claim 8, wherein one of said first and second thread brake elements is an elastically flexible lamellar brake element, and another of said first and second thread brake elements is a rigid brake shoe or plate element.

12. The apparatus according to claim 8, including no additional actuator in addition to said first actuator, and including no additional force pickup transducer mechanically coupled to said second thread brake element, wherein said second thread brake element is a passive non-actuated thread brake element.

13. The apparatus according to claim 8, wherein said thread brake arrangement further includes a second actuator connected to and acting on said second thread brake element so as to move and adjustably press said second thread brake element relative to said first thread brake element.

14. The apparatus according to claim 1, wherein said thread brake arrangement further includes a first actuator having said control signal input and being mechanically connected to and acting on said first thread brake element so as to move and adjustably press said first thread brake element against the thread.

15. The apparatus according to claim 14, wherein said first actuator comprises a piezoelectric actuator.

16. The apparatus according to claim 1, excluding a thread tension sensor separate from and additional to said force pickup transducer.

17. The apparatus according to claim 1, wherein the thread passes through said apparatus along a straight linear thread path and the thread is not deflected out of the straight linear thread path by said apparatus.

18. In a thread brake apparatus for regulating the thread tension of a thread in a textile processing machine, including a thread brake element adapted to adjustably contact and press against the thread, an actuator that is mechanically connected to said thread brake element and adapted to adjustably press said thread brake element against the thread, and a controller that is connected to and controls said actuator, an improvement comprising a force pickup transducer that is mechanically coupled to said thread brake element so as to receive from said thread brake element a reaction force that is oriented parallel to the thread and that is exerted on said thread brake element by the thread.

19. A method of regulating the thread tension of a thread in a textile processing machine, comprising the steps:

a) applying a braking force from a thread brake element onto a thread, thereby giving rise to a thread tension in said thread;

b) as a reaction to said step a), exerting a reaction force from said thread onto said thread brake element, wherein said reaction force is oriented parallel to said thread;

c) sensing said reaction force exerted on said thread brake element; and d) adjusting said braking force in said step a) responsive to and dependent on said reaction force sensed in said step c), and thereby regulating said thread tension.

20. The method according to claim 19, further comprising a non-braking operating phase including moving said thread brake element out of contact with said thread, wherein said thread passes by said thread brake element along a straight linear thread path without being deflected, without physical contact, and without frictional hindrance by any mechanical component.

* * * * *